US007530674B2

(12) United States Patent
Kyoso

(10) Patent No.: US 7,530,674 B2
(45) Date of Patent: May 12, 2009

(54) LIQUID EJECTION HEAD AND IMAGE FORMING APPARATUS

(75) Inventor: Tadashi Kyoso, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 434 days.

(21) Appl. No.: 11/512,312

(22) Filed: Aug. 30, 2006

(65) Prior Publication Data

US 2007/0064061 A1 Mar. 22, 2007

(30) Foreign Application Priority Data

Aug. 31, 2005 (JP) ..... 2005-252052

(51) Int. Cl.
*B41J 2/045* (2006.01)

(52) U.S. Cl. ..... 347/68

(58) Field of Classification Search ..... 347/68, 347/69–72; 310/311, 317, 323.17
See application file for complete search history.

(56) References Cited

U.S. PATENT DOCUMENTS

2002/0191055 A1* 12/2002 Shingai et al. ..... 347/70

FOREIGN PATENT DOCUMENTS

JP 2003-127363 A 5/2003

* cited by examiner

*Primary Examiner*—K. Feggins
(74) *Attorney, Agent, or Firm*—Birch, Stewart, Kolasch and Birch, LLP

(57) ABSTRACT

The liquid ejection head comprises: a plurality of nozzles through which liquid is ejected; a plurality of pressure chambers which accumulate the liquid to be supplied to the nozzles; a plurality of pressure generating devices which apply pressure to the liquid inside the pressure chambers to eject the liquid through the nozzles; a common flow channel through which the liquid is supplied to the pressure chambers; and a wall which defines the common flow channel, at least a portion of the wall being composed of at least two layers including first and second members, a first surface of the first member coming in contact with the liquid in the common flow channel, the second member being arranged on a second surface of the first member reverse to the first surface, wherein: the first member has a thickness L which satisfies the following condition: $L=\lambda\times(2n+1)/4$, where $\lambda$ is a wavelength of an acoustic wave traveling through the first member, and n is an integer not smaller than zero; and an acoustic impedance $Z_1$ of the liquid in the common flow channel, an acoustic impedance $Z_2$ of the first member, and an acoustic impedance $Z_3$ of the second member satisfy one of the following conditions: $Z_1<Z_2<Z_3$ and $Z_3<Z_2<Z_1$.

12 Claims, 9 Drawing Sheets

LIQUID EJECTION HEAD AND IMAGE FORMING APPARATUS

BACKGROUND OF THE INVENTION

1. Field of the Invention

The present invention relates to a liquid ejection head and an image forming apparatus, and more particularly, to a liquid ejection head and an image forming apparatus in which liquid is supplied to a plurality of pressure chambers from a common flow channel which accumulates the liquid, and the liquid inside the pressure chambers is pressurized by pressure generating devices and is ejected from nozzles connected to the pressure chambers.

2. Description of the Related Art

In the related art, a print head based on an inkjet method (inkjet head) is known, in which ink is supplied from a common flow channel, which accumulates the ink, to a plurality of pressure chambers, the ink inside the pressure chambers is pressurized by pressure generating devices, typically piezoelectric elements, and the ink is thereby ejected from nozzles connected to the pressure chambers.

In order to prevent fluid crosstalk in the print head, it is common to use a structure having air dampers provided inside the print head. The fluid crosstalk is a phenomenon where the acoustic waves generated by a particular pressure chamber during ink ejection travel through the common flow channel and penetrate into the other pressure chambers, thereby having an adverse effect on ink ejection in the other nozzles. The main cause of the fluid crosstalk is acoustic waves of 200 kHz to 300 kHz, which is the resonance frequency of the pressure chamber system. Japanese Patent Application Publication No. 2003-127363, for example, discloses a structure in which air dampers are provided inside the common flow channel so that the acoustic waves are attenuated by means of the deformation of these air dampers to prevent the fluid crosstalk.

However, there are problems in the print heads in the related art as follows.

An index of the performance of the air damper is the acoustic capacitance $C_d$, which represents the deformability of the damper. A damper having a high acoustic capacitance $C_d$ is excellent at preventing the fluid crosstalk. When the damper is taken to be a beam structure with two fixed ends, the damper's acoustic capacitance $C_d$ is directly proportional to the fifth power of the damper width W, and inversely proportional to the third power of the damper thickness t. In other words, increasing the damper width W and reducing the damper thickness t serve to raise the damper's acoustic capacitance $C_d$. However, in recent years, with the increasing density of nozzle arrangements, it has become impossible to achieve sufficient space for installing air dampers, and the width W of dampers has become narrowed. Consequently, a situation arises in which sufficient acoustic capacitance $C_d$ cannot be guaranteed in the damper, and hence it becomes impossible to prevent the fluid crosstalk. Of course, it is possible to raise the damper's acoustic capacitance $C_d$ by reducing the thickness t of the damper. However, if the damper's thickness t is reduced, then the damper becomes more liable to fracturing and there is an increased risk of ink leakage. In this way, there are problems in methods which use the air dampers, and from a cost viewpoint, it is desirable to be able to prevent the fluid crosstalk by means of another method, other than the air dampers.

As a method other than one based on the air dampers, a composition may be adopted in which the acoustic waves generated when ink is ejected are attenuated inside the common flow channel. However, it is not possible to expect attenuation of the acoustic waves inside the common flow channel. This is because the acoustic attenuation constant in ink (liquid) is low, and furthermore, because the common flow channel has a small size and the acoustic waves only travel a short distance therein, generally in the order of several millimeters. In other words, the acoustic waves are hardly attenuated at all, and hence the fluid crosstalk cannot be prevented.

Therefore, it has been thought that rather than seeking to attenuate the acoustic waves inside the common flow channel, a composition should be adopted which allows the acoustic waves to escape into the main body of the head (for example, into a wall defining the common flow channel, and the like). The main body of the head is solid and has a greater damping effect than the ink (liquid), and furthermore it has a length of several tens millimeters, and hence the acoustic waves travel through a relatively long distance. Consequently, the acoustic waves are attenuated more readily than they are in the ink (liquid). However, in practice, it is difficult to get the acoustic waves inside the common flow channel to escape into the main body of the head. This is because there is extremely high acoustic reflectivity between a liquid and a solid.

Here, as shown in FIG. 15, a case is considered in which an acoustic wave propagated through the ink inside the common flow channel strikes the main body of the head (solid) perpendicularly. Taking $Z_1$ to be the acoustic impedance of the ink (liquid), and $Z_3$ to be the acoustic impedance of the head main body (solid), the acoustic energy transmission rate $T_0$ is expressed in the following formula (1):

$$T_0 = \frac{4}{\left(\sqrt{\frac{Z_1}{Z_3}} + \sqrt{\frac{Z_3}{Z_1}}\right)^2}. \tag{1}$$

For example, if $Z_1=1.5\times10^6$ (Ns/m$^3$) (the acoustic impedance of the liquid), and $Z_3=45.7\times10^6$ (Ns/m$^3$) (the acoustic impedance of SUS 347 stainless steel), then according to the formula (1), the acoustic energy transmission rate $T_0$=13%. In other words, a little under 90% of the energy of the acoustic wave is reflected by the head main body, and this reflected wave generates crosstalk.

SUMMARY OF THE INVENTION

The present invention has been contrived in view of the foregoing circumstances, an object thereof being to provide a liquid ejection head and image forming apparatus in which fluid crosstalk can be prevented.

In order to attain the aforementioned object, the present invention is directed to a liquid ejection head, comprising: a plurality of nozzles through which liquid is ejected; plurality of pressure chambers which accumulate the liquid to be supplied to the nozzles; a plurality of pressure generating devices which apply pressure to the liquid inside the pressure chambers to eject the liquid through the nozzles; common flow channel through which the liquid is supplied to the pressure chambers; and wall which defines the common flow channel, at least a portion of the wall being composed of at least two layers including first and second members, a first surface of the first member coming in contact with the liquid in the common flow channel, the second member being arranged on a second surface of the first member reverse to the first surface, wherein: he first member has a thickness L which satisfies the following condition: $L=\lambda\times(2n+1)/4$, where $\lambda$ is a wavelength of an acoustic wave traveling through the first member, and n is an integer not smaller than zero; and an acoustic impedance $Z_1$ of the liquid in the common flow channel, an acoustic impedance $Z_2$ of the first member, and an acoustic impedance $Z_3$ of the second member satisfy one of the following conditions: $Z_1<Z_2<Z_3$, and $Z_3<Z_2<Z_1$. member, and an acoustic impedance $Z_3$ of the second member satisfy one of the following condition: $Z_1<Z_2<Z_3$, and $Z_3<Z_2<Z_1$.

According to the present invention, since the acoustic energy transmission rate of the acoustic wave in the first member and the second member constituting a portion of the wall of the common flow channel is improved, it is possible to make the acoustic wave generated during liquid ejection escape into the main body of the head (into the common flow channel wall), and therefore, it is possible to prevent fluid crosstalk.

Preferably, the acoustic impedance $Z_1$ of the liquid in the common flow channel, the acoustic impedance $Z_2$ of the first member, and the acoustic impedance $Z_3$ of the second member satisfy the following condition: $Z_2 \cong \sqrt{Z_1 Z_3}$.

According to this aspect of the present invention, the energy transmission rate of the acoustic wave becomes the maximum, and hence a high fluid crosstalk prevention effect can be achieved.

Preferably, the common flow channel is disposed on a side of the pressure chambers reverse to a side adjacent to the nozzles.

According to this aspect of the present invention, the liquid ejection head has excellent refilling properties.

Preferably, the portion of the wall is disposed on a side of the common flow channel reverse to a side adjacent to the pressure chambers.

According to this aspect of the present invention, it is possible to allow the acoustic wave generated in the pressure chambers during liquid ejection to efficiently escape into the main body of the head (into the wall of the common flow channel), and hence fluid crosstalk can be prevented reliably.

Preferably, the second member includes a liquid tank in which the liquid to be supplied to the common flow channel is stored; and a supply flow channel which connects the liquid tank to the common flow channel is formed in the first member.

According to this aspect of the present invention, it is possible to prevent fluid crosstalk, as well as disposing the liquid tank in a highly efficient manner.

Preferably, the liquid ejection head further comprises a filter member which is arranged in at least a portion of the supply flow channel.

According to this aspect of the present invention, it is possible to prevent the enter of foreign matter from the liquid tank into the common flow channel.

Preferably, the portion of the supply flow channel where the filter member is arranged has a cross-sectional area broader than that of the other portions of the supply flow channel.

According to this aspect of the present invention, it is possible to reduce the pressure loss caused by the filter member.

Preferably, a heater wire is arranged in the first member.

According to this aspect of the present invention, it is possible to prevent ejection errors caused by increased viscosity of the liquid inside the common flow channels.

Preferably, a Peltier element is arranged in the first member.

According to this aspect of the present invention, in a case where the second member is a circuit substrate, it is possible to prevent deterioration of the circuit elements, as well as to prevent ejection errors caused by increased viscosity of the liquid inside the common flow channel.

Preferably, a liquid circulation path is formed in the first member.

According to this aspect of the present invention, the liquid circulation path can be incorporated efficiently into the liquid ejection head.

Preferably, wiring members for driving the pressure generating devices are arranged in the first member.

According to this aspect of the present invention, it is possible to install high-density wiring.

In order to attain the aforementioned object, the present invention is also directed to an image forming apparatus, comprising the above-described liquid ejection head.

According to the present invention, since the acoustic energy transmission rate of the acoustic waves in the first member and the second member constituting one portion of the wall of the common flow channel is improved, it is possible to make the acoustic waves generated during liquid ejection escape into the main body of the head (into the common flow channel wall), and therefore, it is possible to prevent fluid crosstalk.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
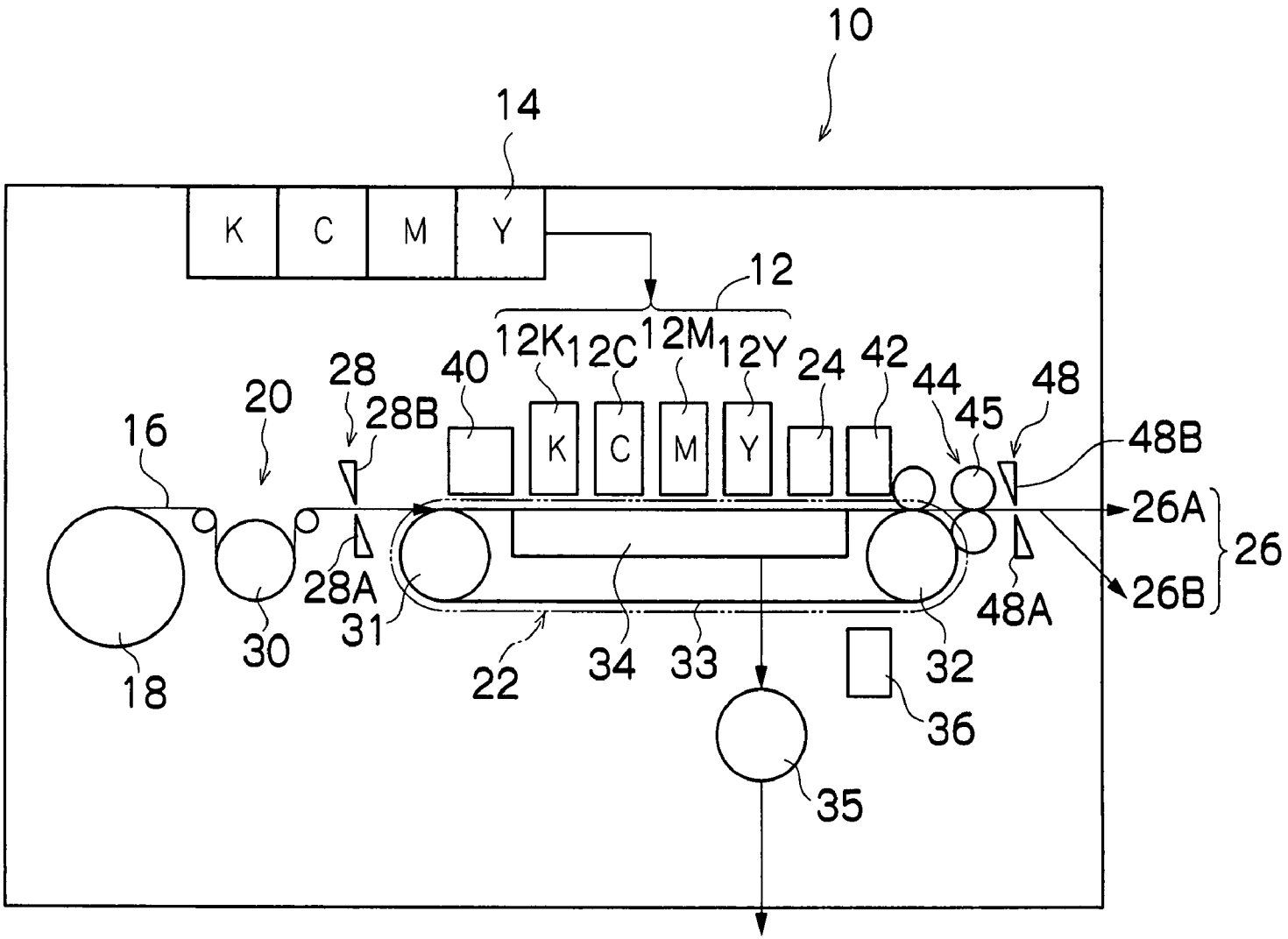
FIG. 1 is a general schematic drawing showing a general view of an inkjet recording apparatus 10.

FIG. 1 is a general schematic drawing of an inkjet recording apparatus which forms an image forming apparatus according to an embodiment of the present invention. As shown in FIG. 1, the inkjet recording apparatus 10 comprises: a print unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub-scanning direction). The print heads 12K, 12C, 12M and 12Y forming the print unit 12 are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in a direction (main-scanning direction) that is perpendicular to the paper conveyance direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor (line sensor and the like) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in the drawings, the paper output unit 26A for the target prints is provided with a sorter for collecting prints according to print orders.

Structure of Print Head

The print heads 12K, 12C, 12M and 12Y provided for the respective ink colors have the same structure, and a reference numeral 50 is hereinafter designated to a representative example of these print heads.

Figure 2:
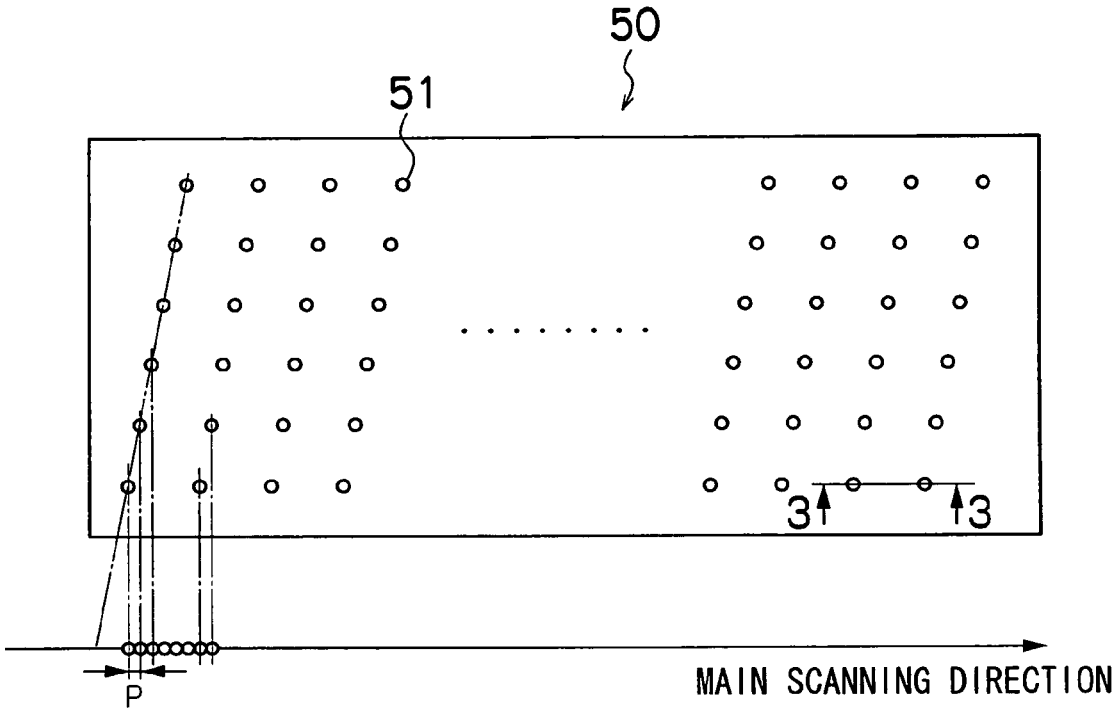
FIG. 2 is a plan diagram showing the ink ejection surface of a print head.

FIG. 2 is a plan diagram showing the ink ejection surface of the print head 50. In the print head 50 according to the present embodiment, nozzles 51 which eject ink droplets are arranged two-dimensionally (in a matrix configuration) in a main scanning direction and an oblique direction which is not perpendicular to the main scanning direction. The projected nozzle row obtained by projecting the nozzles to an alignment in the main scanning direction is aligned equidistantly at a uniform nozzle pitch P, thereby achieving high resolution of the dot pitch printed onto the surface of the recording paper.

Figure 3:
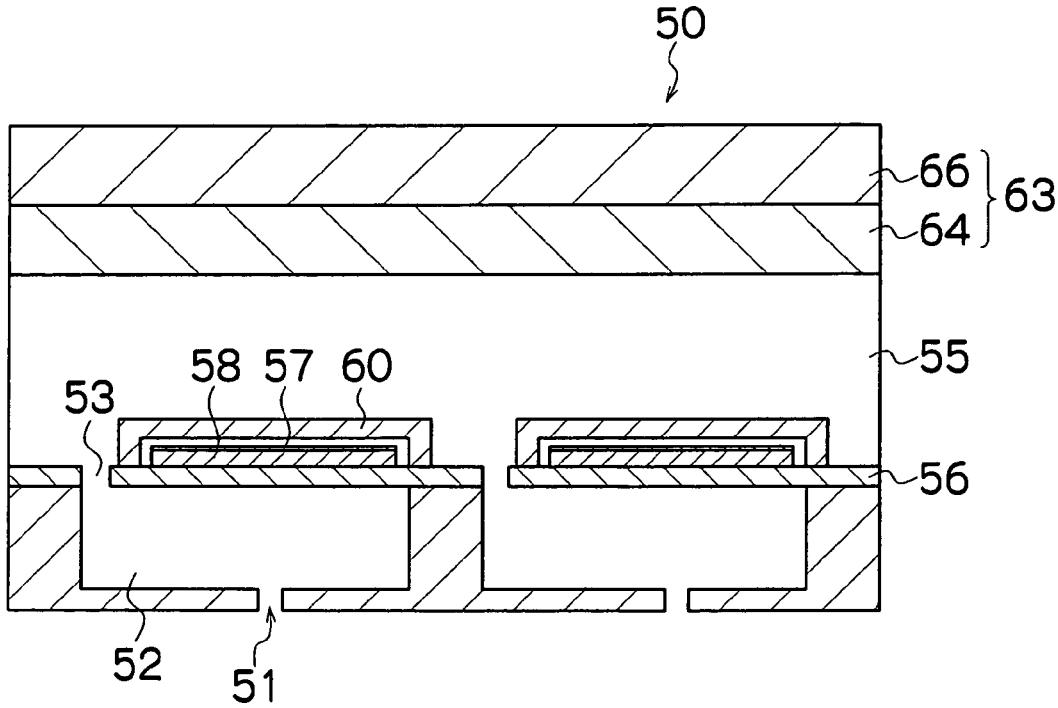
FIG. 3 is a cross-sectional diagram along line 3-3 in FIG. 2.

FIG. 3 is a cross-sectional diagram along line 3-3 in FIG. 2. As shown in FIG. 3, the nozzles 51 are formed on the lower wall side of the pressure chambers 52, which are filled with the ink. The diaphragm 56 constitutes the upper wall of the plurality of pressure chambers 52, and a common liquid chamber 55, which accumulates the ink, is formed on the side of the diaphragm 56 reverse to the side adjacent to the pressure chambers 52. The common liquid chamber 55 is the main mode of the common flow channel according to the embodiment of the present invention, and it may be constituted by a main channel and distributary channels. Supply ports (through holes) 53 are formed in the diaphragm 56 in order to supply the ink to the pressure chambers 52 from the common liquid chamber 55.

In the print head 50, since the common liquid chamber 55 is located on the side of the diaphragm 56 reverse to the side of the nozzles 51 of the pressure chambers 52, then it is possible to supply the ink efficiently from the common liquid chamber 55 to the pressure chambers 52, through the supply ports 53. In other words, the head structure having excellent refilling characteristics is obtained.

Piezoelectric elements (pressure generating devices) 58 provided with individual electrodes 57 are arranged on the side of the diaphragm 56 reverse to the side adjacent to the pressure chambers 52, at positions corresponding to the pressure chambers 52. In the present embodiment, the diaphragm 56 is made of a conductive member such as stainless steel, and it also serves as a common electrode for the piezoelectric elements 58. It is also possible for the diaphragm 56 be composed of a non-conductive member, and for a conductive layer to be formed on the surface adjacent to the piezoelectric elements 58. On the side of the diaphragm 56 where the piezoelectric elements 58 are formed, protective covers 60 are provided respectively so as to surround the respective piezoelectric elements 58, in such a manner that a prescribed space is guaranteed in the peripheral region of each piezoelectric element 58. Accordingly, electrical insulating properties are guaranteed with respect to the ink inside the common liquid chamber 55, and furthermore, the displacement of the piezoelectric elements 58 is not constrained.

When a drive signal (drive voltage) is applied to the piezoelectric element 58, the diaphragm 56 is deformed so as to bend toward the pressure chamber 52 side, due to the displacement of the piezoelectric element 58. Consequently, the ink inside the pressure chamber 52 is pressurized and an ink droplet is ejected from the nozzle 51.

In the print head 50, the upper wall 63 of the common liquid chamber 55 is constituted by two layers: an intermediate layer 64 (first member) and a surface layer 66 (second member), and this composition prevents the fluid crosstalk, in which the acoustic waves generated inside the pressure chambers 52 during ink ejection are propagated into the common liquid chamber 55 through the supply ports 53, and penetrate into the other pressure chambers 52, thus creating adverse effects. A more specific description of the method of preventing the fluid crosstalk is given later.

Figure 4:
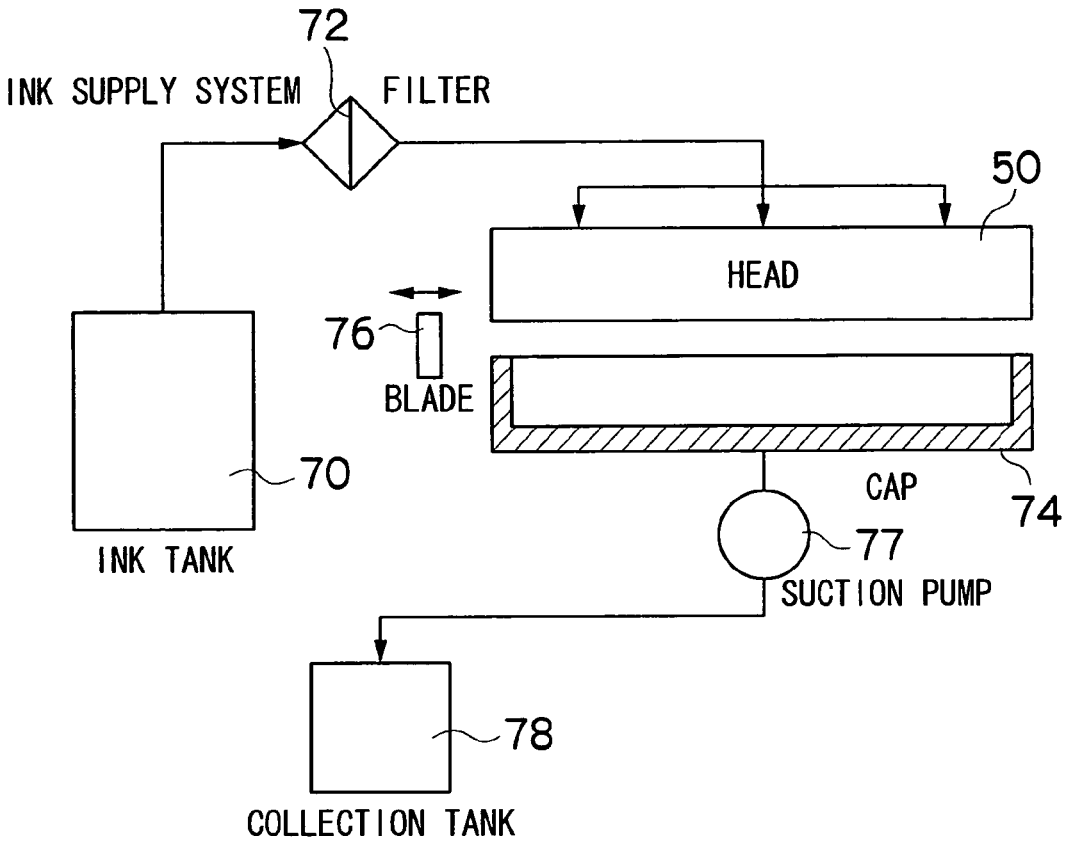
FIG. 4 is a schematic drawing showing the composition of an ink supply system.

FIG. 4 is a schematic drawing showing the configuration of the ink supply system in the inkjet recording apparatus 10. An ink tank 70 is a base tank, which supplies ink to the print head 50 and is set in the ink storing and loading unit 14 described with reference to FIG. 1. The aspects of the ink tank 70 include a refillable type and a cartridge type: when the remaining amount of ink is low, the ink tank 70 of the refillable type is filled with ink through a filling port (not shown) and the ink tank 70 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 70 in FIG. 4 is equivalent to the ink storing and loading unit 14 in FIG. 1 described above.

A filter 72 for removing foreign matters and bubbles is disposed between the ink tank 70 and the print head 50 as shown in FIG. 4. The filter mesh size in the filter 72 is preferably equivalent to or less than the diameter of the nozzle and commonly about 20 μm. Although not shown in FIG. 4, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 74 as a device to prevent the nozzles 51 from drying out or to prevent an increase in the ink viscosity in the vicinity of the nozzles 51, and a cleaning blade 76 as a device to clean the nozzle face. A maintenance unit including the cap 74 and the cleaning blade 76 can be relatively moved with respect to the print head 50 by a movement mechanism (not shown), and is moved from a predetermined holding position to a maintenance position below the print head 50 as required.

The cap 74 is displaced up and down relatively with respect to the print head 50 by an elevator mechanism (not shown). When the power of the inkjet recording apparatus 10 is turned OFF or when in a print standby state, the cap 74 is raised to a predetermined elevated position so as to come into close contact with the print head 50, and the nozzle face is thereby covered with the cap 74.

During printing or standby, if the use frequency of a particular nozzle 51 is low, and if a state of not ejecting ink continues for a prescribed time period or more, then the solvent of the ink in the vicinity of the nozzle evaporates and the viscosity of the ink increases. In a situation of this kind, it will become impossible to eject ink from the nozzle 51, even if the piezoelectric element 58 is operated.

Therefore, before a situation of this kind develops (namely, while the ink is within a range of viscosity which allows it to be ejected by operation of the piezoelectric element 58), the piezoelectric element 58 is operated, and a preliminary ejection ("purge", "blank ejection" or "liquid ejection") is carried out toward the cap 74 (ink receptacle), in order to expel the degraded ink.

Furthermore, if bubbles enter into the ink inside the print head 50 (inside the pressure chamber 52), then even if the piezoelectric element 58 is operated, it will not be possible to eject ink from the nozzle 51. In a case of this kind, the cap 74 is placed on the print head 50, the ink (ink containing bubbles) inside the pressure chamber 52 is removed by suction, by means of a suction pump 77, and the ink removed by suction is then supplied to a collection tank 78. This suction operation is also carried out in order to remove degraded ink having increased viscosity (hardened ink), when ink is loaded into the print head 50 for the first time, and when the head starts to be used after having been out of use for a long period of time. Since the suction operation is carried out with respect to all of the ink inside the pressure chamber 52, the ink consumption is considerably large. Therefore, desirably, preliminary ejection is carried out when the increase in the viscosity of the ink is still minor.

The cleaning blade 76 is composed of rubber or another elastic member, and can slide on the nozzle surface of the print head 50 by means of a blade movement mechanism (not shown). If there are ink droplets or foreign matter adhering to the nozzle surface, then the nozzle surface is wiped by causing the cleaning blade 76 to slide over the nozzle surface, thereby cleaning the nozzle surface. When soiling on the nozzle surface has been cleaned away by means of the blade movement mechanism, a preliminary ejection is carried out in order to prevent infiltration of foreign matter into the nozzles 51.

Method of Preventing Fluid Crosstalk

Next, a method of preventing fluid crosstalk is described.

Figure 5:
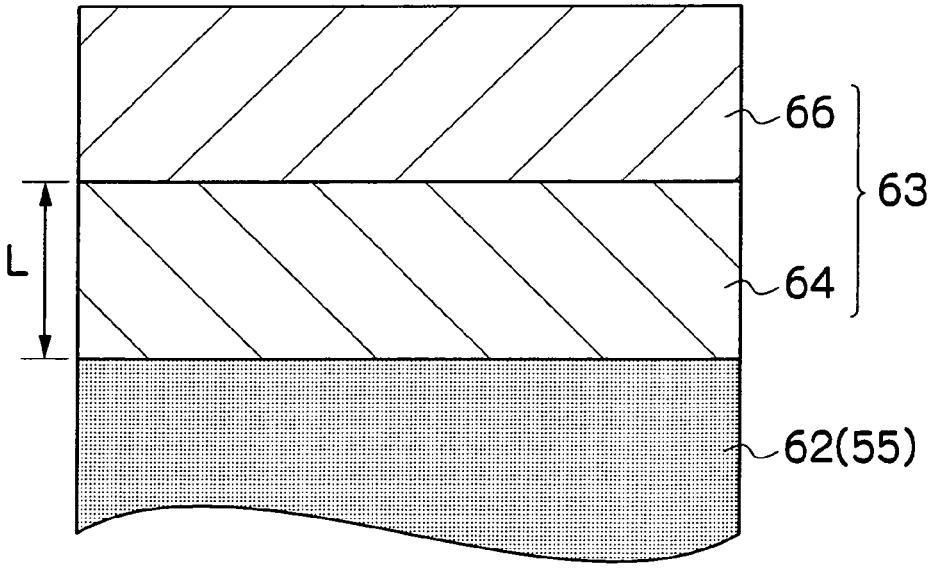
FIG. 5 is a principal cross-sectional diagram showing the periphery of the upper wall of a common liquid chamber of a print head.

FIG. 5 is a principal cross-sectional diagram showing the periphery of the upper wall 63 of the common liquid chamber 55 in the print head 50. In FIG. 5, reference numeral 62 indicates the ink layer accumulated inside the common liquid chamber 55. As stated previously, the upper wall 63 of the common liquid chamber 55 has the two-layer composition including the intermediate layer (first member) 64 and the surface layer (second member) 66. Alternatively, it is also possible that the upper wall 63 of the common liquid chamber 55 is constituted by three or more layers. The surface layer 66 is constituted, for example, by an ink tank, a build-up substrate, a head fixing member, or the like.

The intermediate layer 64 is designed to have the thickness L that satisfies the following condition (2):

$$L=\lambda\times(2n+1)/4, \tag{2}$$

where λ is the wavelength of the acoustic wave traveling through the intermediate layer 64, and n is an integer not smaller than zero (i.e., n=0, 1, 2, . . . ).

In this case, the acoustic energy transmission rate $T_1$ is expressed in the following formula (3):

$$T_1 = \frac{4}{\left(\frac{\sqrt{Z_1 Z_3}}{Z_2} + \frac{Z_2}{\sqrt{Z_1 Z_3}}\right)^2}, \quad (3)$$

where $Z_1$ is the acoustic impedance of the ink layer 62, $Z_2$ is the acoustic impedance of the intermediate layer 64, and $Z_3$ is the acoustic impedance of the surface layer 66.

If the composition is such that the acoustic impedances $Z_1$, $Z_2$ and $Z_3$ satisfy the following condition (4):

$$Z_{1<Z2}<Z_3, \text{ or } Z_3<Z_2<Z_1; \quad (4)$$

then the acoustic energy transmission rate $T_1$ of the present embodiment is equal to or greater than the acoustic energy transmission rate $T_0$ in the related art described above. In other words, by adopting the composition that satisfies the above-described conditions (2) and (4), the acoustic energy transmission rate is increased in comparison with the related art, and it is hence possible for the energy of the acoustic waves propagated into the common liquid chamber 55 from the pressure chambers 52 during ink ejection to escape into the wall 63 (the intermediate layer 64 and the surface layer 66) defining the common liquid chamber 55. It is thus possible to prevent the fluid crosstalk.

Here, for example, the acoustic energy transmission rate $T_1$ is determined for a case where a glass layer, for example, is introduced as the intermediate layer 64 between the ink layer 62 (liquid) and the surface layer 66 (SUS 347 stainless steel), supposing that $Z_1=1.5\times10^6$ (Ns/m$^3$) (the acoustic impedance of the liquid), and $Z_3=45.7\times10^6$ (Ns/m$^3$) (the acoustic impedance of SUS 347), similarly to the example described above. The acoustic energy transmission rate $T_0$ when there is no intermediate layer 64 is 13%, as stated previously.

Supposing that the acoustic speed of the glass layer is 5100 (m/s) and the frequency of the fluid crosstalk to be countered is 300 (kHz), then the wavelength $\lambda$ of the acoustic wave traveling through the glass layer is 17 (mm). Therefore, the thickness L of the glass layer to satisfy the above-described condition (2) is 4.25 (mm). In other words, it is desirable that the glass layer having the thickness of 4.25 (mm) is positioned between the ink layer 62 and the surface layer 66, as the intermediate layer 64. Furthermore, the acoustic impedance of the glass $Z_2$ is $13.2\times10^6$ (Ns/m$^3$) and satisfies the above-described condition (4).

The acoustic energy transmission rate $T_1$ in the case where the above-described glass layer is disposed as the intermediate layer 64 is $T_1=4/4.92=0.81$ (81%) according to the above-described formula (3), and hence the acoustic energy transmission rate $T_1$ exceeds 80%. Thus, the acoustic energy transmission rate is greatly improved in comparison with the related art, and consequently, it is possible to allow the energy of the acoustic waves generated by ink ejection to escape into the wall 63 (the intermediate layer 64 and the surface layer 66) defining the common liquid chamber 55. Therefore, the fluid crosstalk can be prevented.

It is desirable that the acoustic impedances of the ink layer 62, the intermediate layer 64 and the surface layer 66, $Z_1$, $Z_2$ and $Z_3$ satisfy the following condition (5):

$$Z_2 \cong \sqrt{Z_1 Z_3}. \quad (5)$$

If the condition (5) is satisfied, then the acoustic energy transmission rate $T_1$ becomes the maximum and a high effect in preventing the fluid crosstalk is obtained.

For example, in a case where $Z_1=1.5\times10^6$ (Ns/m$^3$) (the acoustic impedance of liquid), and $Z_3=103\times10^6$ (Ns/m$^3$) (the acoustic impedance of tungsten), then the acoustic energy transmission rate $T_1$ becomes the maximum value if a material having the acoustic impedance of $Z_2=12.4\times10^6$ (Ns/m$^3$) is selected for the intermediate layer 64. Therefore, if glass, which has the acoustic impedance of $Z_2=13.2\times10^6$ (Ns/m$^3$), is selected for the intermediate layer 64, as the material whose acoustic impedance is close to the value ($12.4\times10^6$ (Ns/m$^3$)) at which the acoustic energy transmission rate $T_1$ becomes the maximum, then the acoustic energy transmission rate $T_1=99.5\%$, and hence almost 100% of the acoustic energy is transmitted.

In order for the acoustic energy transmission rate $T_1$ to become 90% or above, a composition is required to satisfy the following condition (6):

$$\sqrt{Z_1 Z_3}\times0.72 \leqq Z_2 \leqq \sqrt{Z_1 Z_3}\times1.39; \quad (6)$$

and in order for $T_1$ to become 95% or above, a composition is required to satisfy the following condition (7):

$$\sqrt{Z_1 Z_3}\times0.80 \leqq Z_2 \leqq \sqrt{Z_1 Z_3}\times1.26. \quad (7)$$

As described above, according to the present embodiment, by adopting the composition in which the upper wall 63 of the common liquid chamber 55 has the two-layer structure composed of the intermediate layer 64 and the surface layer 66, which the structure satisfies the above-described conditions (2) and (4), then the energy transmission rate of the acoustic waves is improved. Consequently, it is possible to make the acoustic waves generated during ink ejection escape into the main body of the head (into the upper wall 63 of the common flow channel 55), and hence the fluid crosstalk can be prevented.

First Modification

Figure 6:
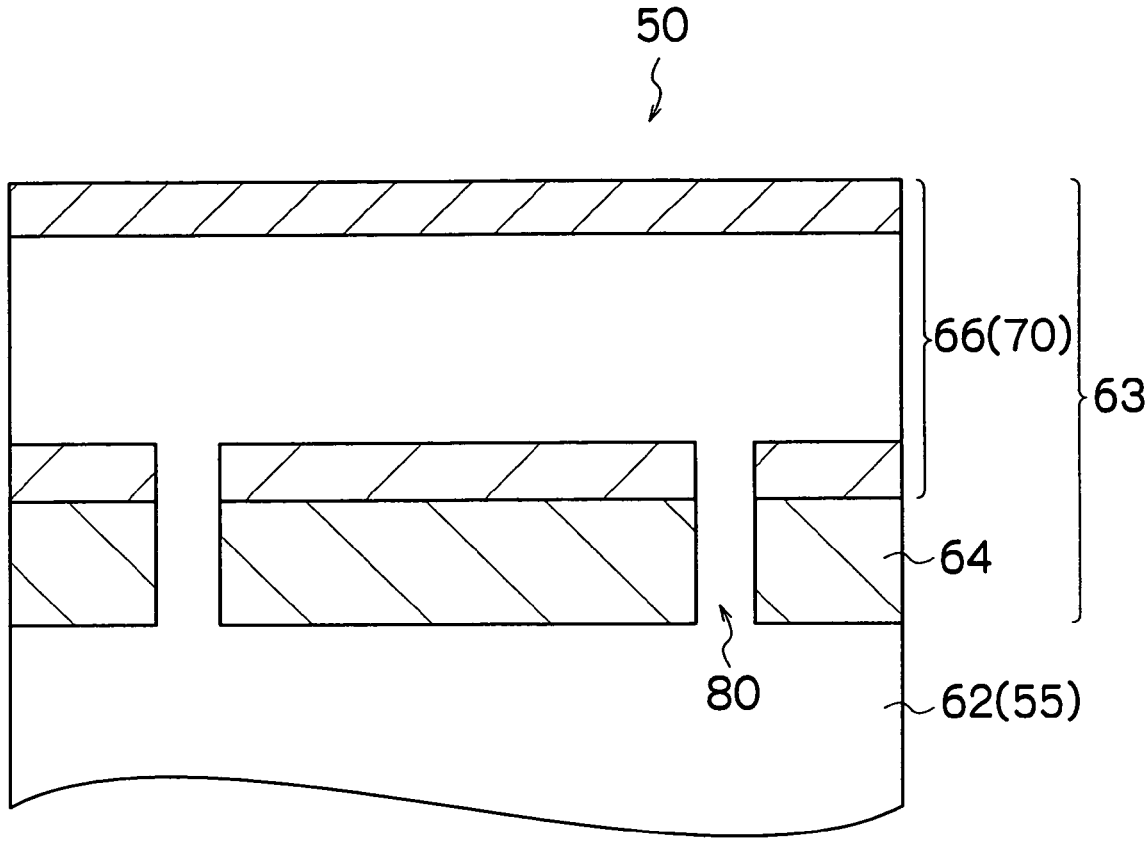
FIG. 6 shows a principal cross-sectional diagram of a first modification example of a print head.

FIG. 6 shows a principal cross-sectional diagram of a first modification of the print head 50. In the first modification, a composition is adopted in which the surface layer 66 also serves as the ink tank 70, and a supply flow channel 80 is formed in the intermediate layer 64. The ink is stored inside the ink tank 70 (surface layer 66), and the ink is supplied to the common liquid chamber 55 through the supply flow channel 80. By adopting this composition, it is possible to prevent the fluid crosstalk, and the ink tank 70 can also be located in a highly efficient manner.

Second Modification

Figure 7:
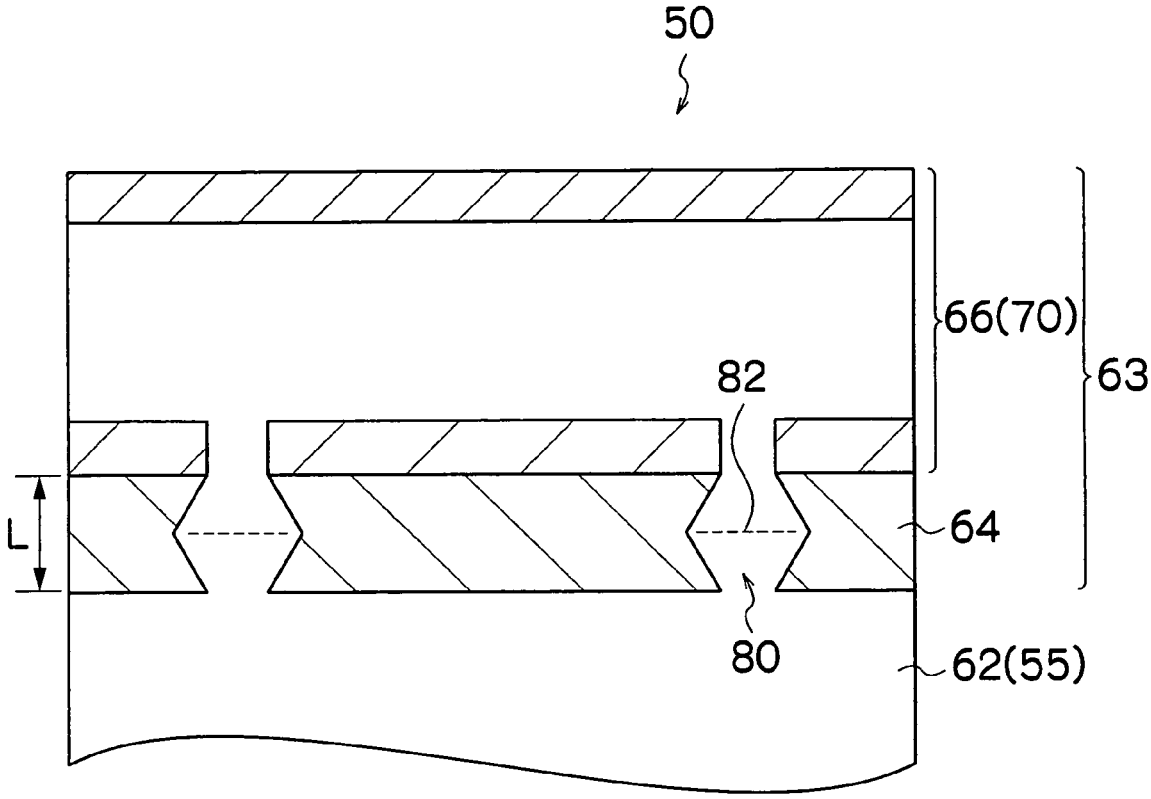
FIG. 7 shows a principal cross-sectional diagram of a second modification example of a print head.

FIG. 7 shows a principal cross-sectional diagram of a second modification of the print head 50. In the second modification, a filter member 82 is arranged in the supply flow channel 80 of the first modification shown in FIG. 6, and furthermore, the cross-sectional area of the flow channel is broadened at the portion where the filter member 82 is disposed, in comparison with the other portions. Consequently, it is possible to prevent the fluid crosstalk, at the same time as reducing the pressure loss caused by the filter member 72.

Figure 8:
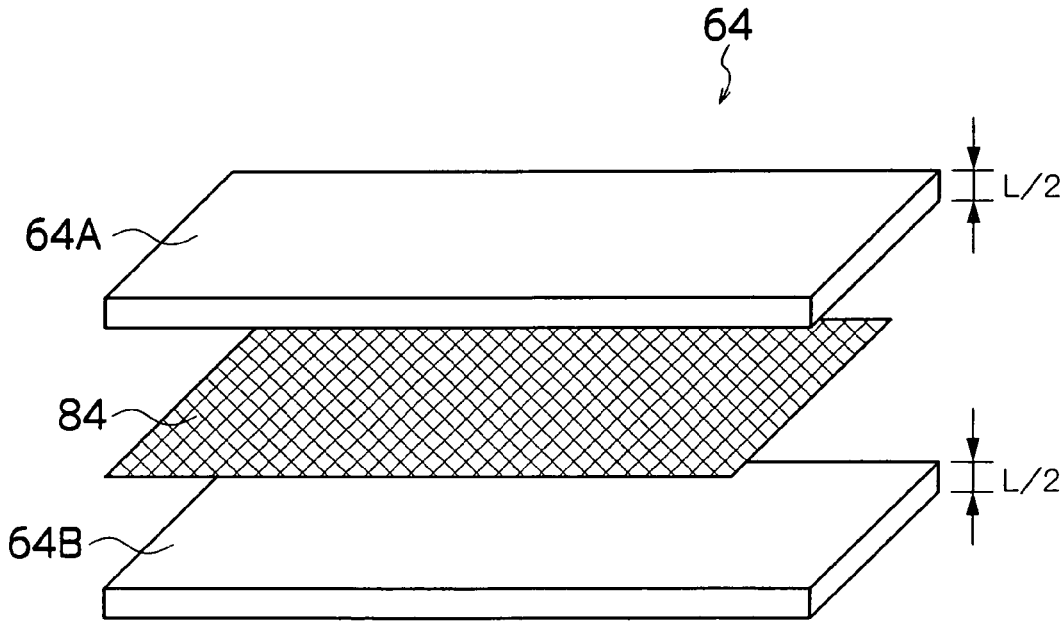
FIG. 8 is an oblique diagram showing a simplified view of a method for fabricating the intermediate layer in FIG. 7.

FIG. 8 is an oblique diagram showing a simplified view of a method for fabricating the intermediate layer 64 in FIG. 7. If the thickness of the intermediate layer 64 in FIG. 7 is taken to be L, then by inserting a filter film 84 between intermediate layers 64A and 64B each having a thickness of L/2 as shown in FIG. 8, it is possible to form the intermediate layer 64 provided with the internal filter member 82. The ratio between the thicknesses of the intermediate layers 64A and 64B is not limited to that of the present embodiment.

Third Modification

Figure 9:
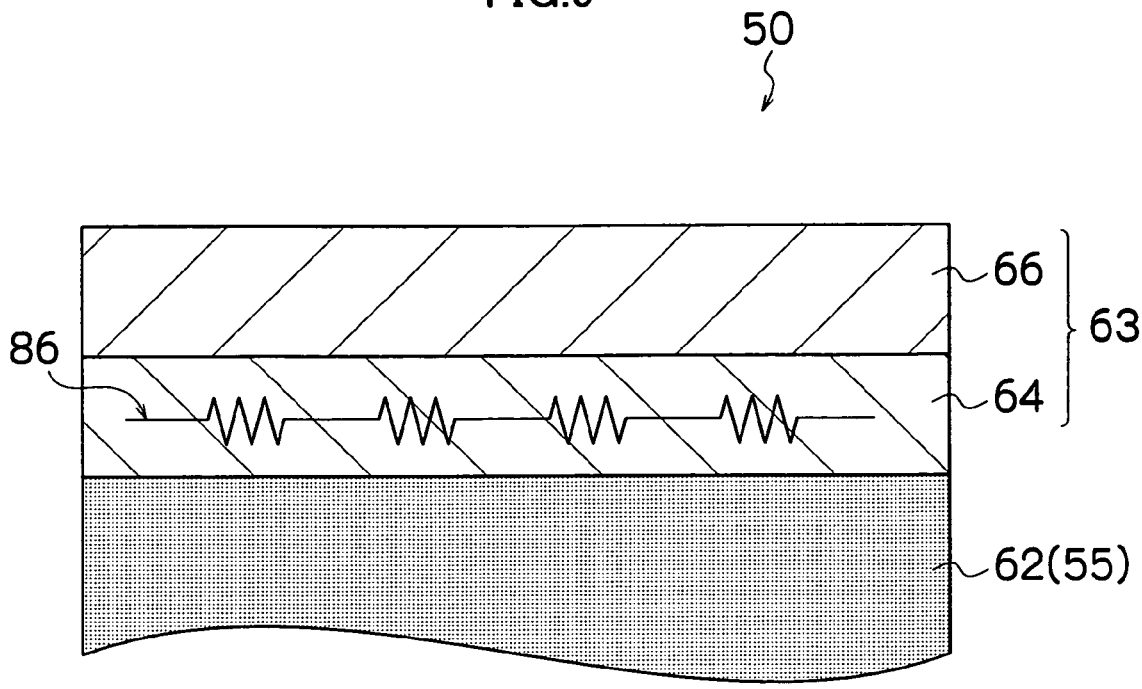
FIG. 9 shows a principal cross-sectional diagram of a third modification example of a print head.

FIG. 9 shows a principal cross-sectional diagram of a third modification of the print head 50. In the third modification, a heater wire 86 is arranged in the intermediate layer 64. Consequently, it is possible to prevent the fluid crosstalk, as well as disposing the heater for adjusting the temperature of the ink (and adjusting the temperature of the head), in a highly efficient manner.

A plurality of heater wires 86 may be provided. The surface layer 66 may be a build-up substrate or a head fixing member, and the surface layer 66 may also serve as the ink tank, as in the first and second modifications. There are no particular restrictions on the position at which the heater wire 86 is located, and the heater wire 86 may be disposed on the side nearby the ink layer 62 (common liquid chamber 55), or on the side nearby the surface layer 66. For example, by disposing the heater wire 86 on the side of the ink layer 62, it is possible to heat the ink layer 62 efficiently, and hence increase in the viscosity of the ink can be suppressed. If the surface layer 66 also serves as the ink tank, then by disposing the heater wire 86 on the side of the surface layer (ink tank) 66, it is possible to heat the ink stored in the ink tank, in an efficient manner. Furthermore, if the heater wires 86 are disposed on either side of the intermediate layer 64 (on both the side nearby the ink layer 62 and the side nearby the surface layer 66), then it is possible to heat the ink located on either side of the intermediate layer 64, more efficiently.

Figure 10:
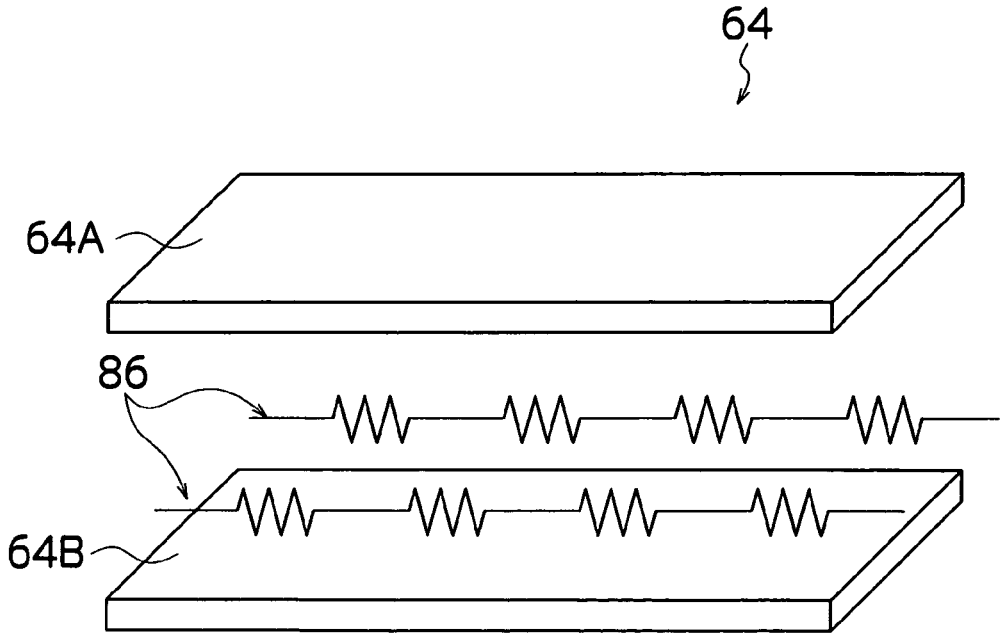
FIG. 10 is an oblique diagram showing a simplified view of a method for fabricating the intermediate layer in FIG. 9.

FIG. 10 is an oblique diagram showing a simplified view of a method for fabricating the intermediate layer 64 in FIG. 9. As shown in FIG. 10, by inserting the heater wires 86 between two intermediate layers 64A and 64B, each of which is thinner than the intermediate layer 64, it is possible to form the intermediate layer 64 provided with the internal heater wires 86. Furthermore, a method such as sputtering, or the like, can be used to form the heater wires 86 on the surface of the intermediate layer 64.

Fourth Modification

Figure 11:
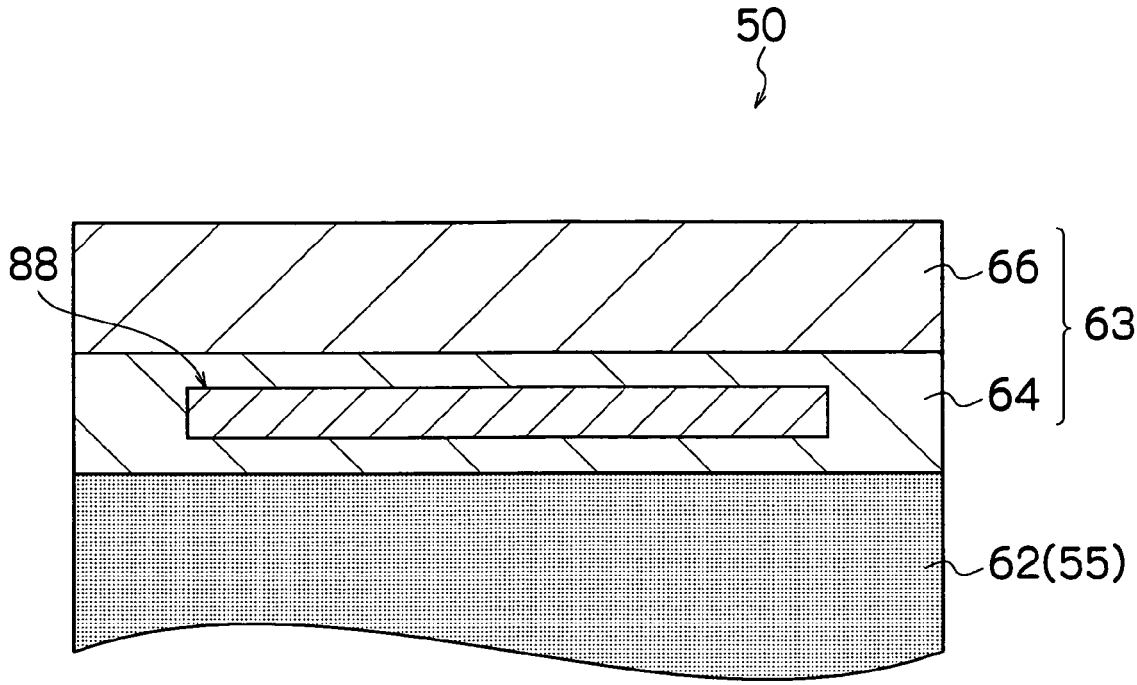
FIG. 11 shows a principal cross-sectional diagram of a fourth modification example of a print head.

FIG. 11 shows a principal cross-sectional diagram of a fourth modification of the print head 50. In the fourth modification, a Peltier element 88 is arranged in the intermediate layer 64. The Peltier element 88 is of a size which can be accommodated within the intermediate layer 64, so that the Peltier element 88 can be disposed efficiently in the intermediate layer 64.

The Peltier element 88 has properties whereby, when one surface becomes hotter, the opposite surface becomes cooler. Therefore, by using the Peltier element 88 disposed in the intermediate layer 64, it is possible to heat either one of the ink layer 62 or the surface layer 66, while cooling the other. For example, if the surface layer 66 is constituted by a build-up substrate, then by applying a voltage to the Peltier element 88 in such a manner that the side of the surface layer 66 is cooled, then it is possible to cool the circuit elements, such as a switching IC, on the substrate, and hence deterioration of the circuit elements can be prevented. Furthermore, since the ink layer 62 disposed on the opposite side to the surface layer 66 is heated in this case, then it is also possible to prevent ejection errors caused by increased viscosity of the ink.

In this way, in the fourth modification, it is possible to prevent the fluid crosstalk, similarly to the first to third modifications described above, as well as being able to prevent deterioration of the circuit elements and ejection errors.

Fifth Modification

Figure 12:
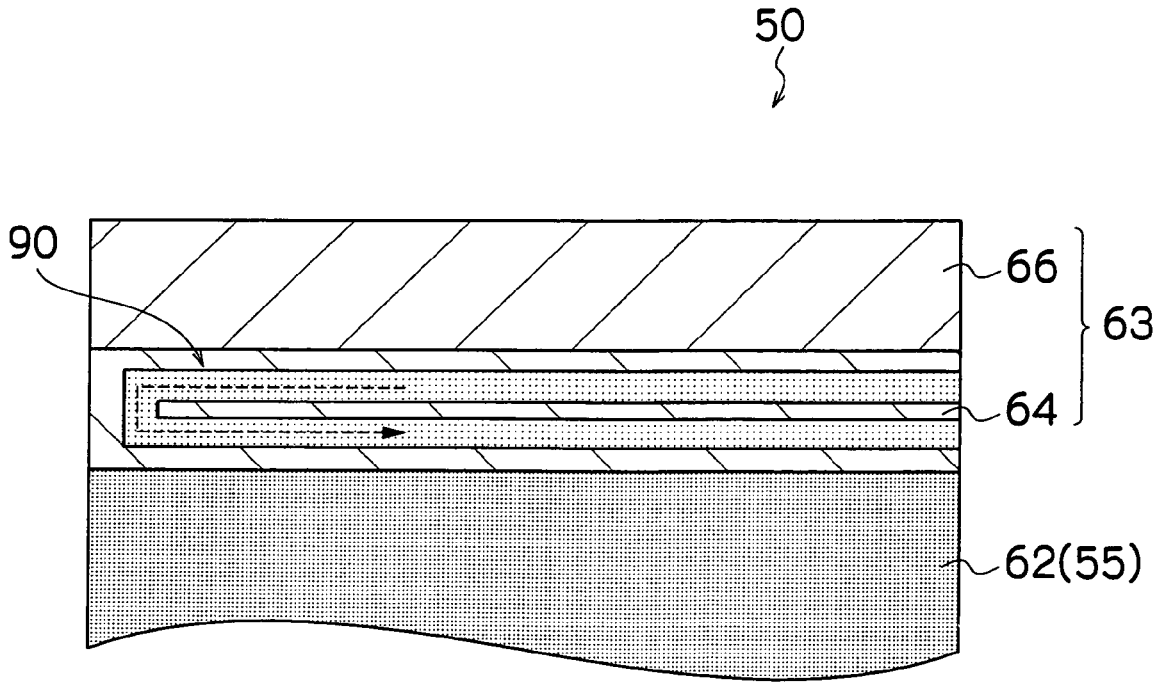
FIG. 12 shows a principal cross-sectional diagram of a fifth modification example of a print head.

FIG. 12 shows a principal cross-sectional diagram of a fifth modification of the print head 50. In the fifth modification, a liquid circulation path 90, through which temperature adjustment liquid flows, is formed in the intermediate layer 64. There are no particular restrictions on the temperature adjustment liquid flowing through the liquid circulation path 90, and the temperature adjustment liquid may be water or ink, for example. A pump (not shown) for circulating the temperature adjustment liquid can be constituted in such a manner that it also serves as another pump (for example, the suction pump 77 shown in FIG. 4, or a pump for circulating ink through the ink flow channel (not shown), or the like). By adopting this composition, it is possible to prevent the fluid crosstalk, while also incorporating the liquid circulation path for temperature adjustment in a highly efficient manner.

Sixth Modification

Figure 13:
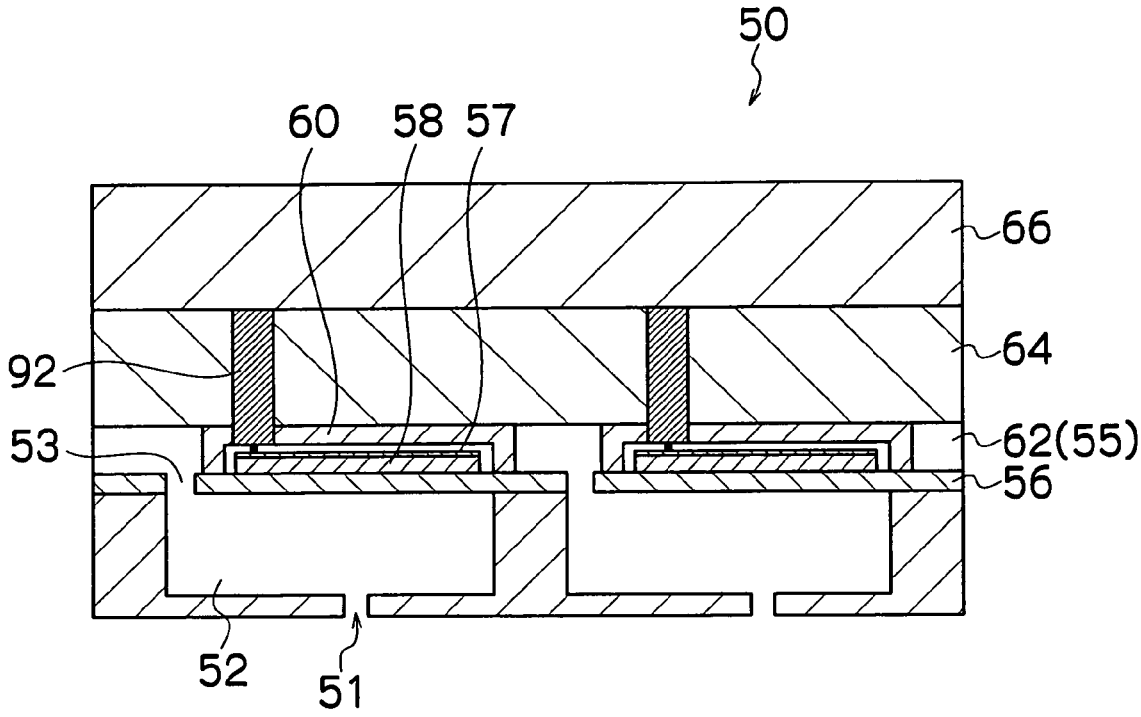
FIG. 13 shows a principal cross-sectional diagram of a sixth modification example of a print head.

FIG. 13 shows a principal cross-sectional diagram of a sixth modification of the print head 50. In the sixth modification, internal wires 92 are formed so as to pass through the intermediate layer 64, in correspondence with the piezoelectric elements 58, and the surface layer 66 is made of a build-up substrate. One end of each internal wire 92 is electrically connected to the individual electrode 57 of the piezoelectric element 58 by passing through the protective cover 60, and the other end of each internal wire 92 is electrically connected to an electrode (not shown) formed on the surface layer (build-up substrate) 66. By connecting the individual electrodes 57 of the piezoelectric elements 58 to the surface layer (build-up substrate) 66 through the internal wires 92 in a substantially perpendicular direction to the diaphragm 56 on which the piezoelectric elements 58 are disposed, it is possible to achieve high-density installation of electrical wires, compared to a case where the electrical wires are extended along the diaphragm 56.

It is possible that wires for elements other than piezoelectric elements 58, such as a temperature sensor, pressure sensor, or the like are also provided as the internal wires 92 arranged in the intermediate layer 64. Furthermore, although the internal wires 92 of the present modification are constituted so as to pass through the intermediate layer 64 in the vertical direction, it is also possible that the internal wires 92 pass through the intermediate layer 64 in the horizontal direction of the intermediate layer 64. In this case, it is possible to constitute the surface layer 66 from a member other than the build-up substrate.

Further Embodiment

Figure 14:
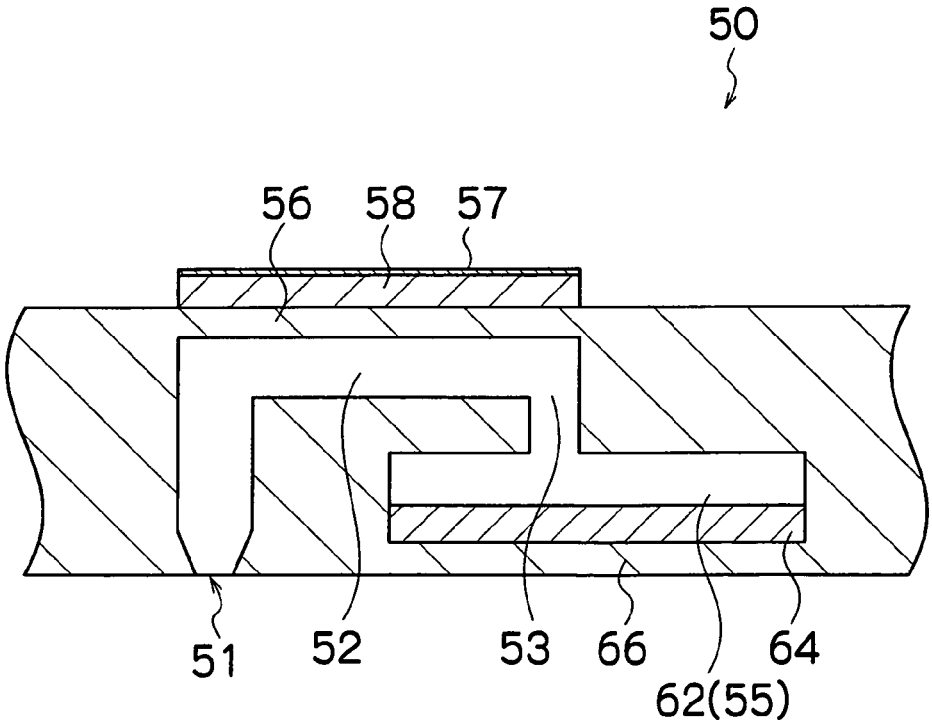
FIG. 14 shows a principal cross-sectional diagram of a further embodiment of a print head.
Figure 15:
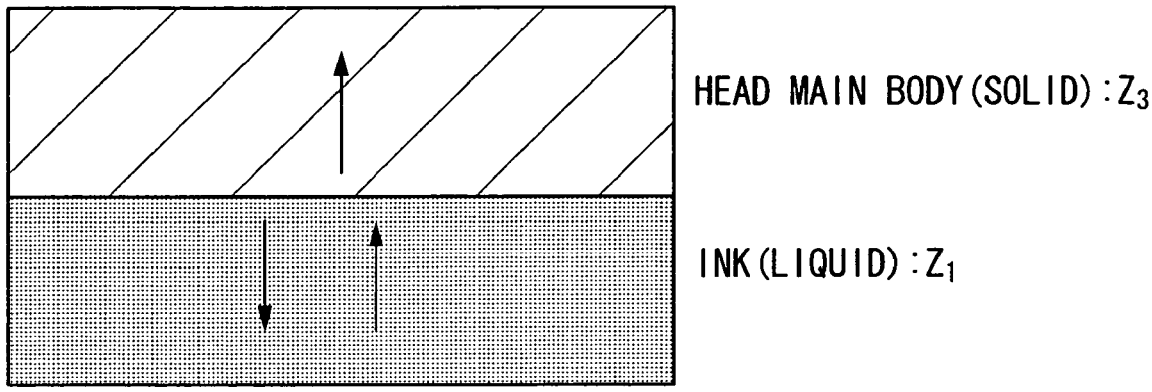
FIG.15 RELATED ART
FIG. 15 is an illustrative diagram of the structure of a head in the related art.

FIG. 14 shows a principal cross-sectional diagram of a further embodiment of the print head 50. The print head 50 shown in FIG. 3 has the common liquid chamber 55 disposed on the side of the pressure chamber 52 reverse to the side adjacent to the nozzles 51 (so that the diaphragm 56 is arranged between the common liquid chamber 55 and the pressure chamber 52), whereas the print head 50 shown in FIG. 14 has the common liquid chamber 55 disposed on the same side of the pressure chambers 52 with the nozzles 51. In this composition of the print head 50, the bottom wall of the common liquid chamber 55 has the two-layer composition composed of the intermediate layer 64 and the surface layer 66. In the print head 50 of this kind also, it is possible to prevent the fluid crosstalk by adopting the composition that satisfies the above-described conditions (2) and (4).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of nozzles through which liquid is ejected;

a plurality of pressure chambers which accumulate the liquid to be supplied to the nozzles;

a plurality of pressure generating devices which apply pressure to the liquid inside the pressure chambers to eject the liquid through the nozzles;

a common flow channel through which the liquid is supplied to the pressure chambers; and a wall which defines the common flow channel, at least a portion of the wall being composed of at least two layers including first and second members, a first surface of the first member coming in contact with the liquid in the common flow channel, the second member being arranged on a second surface of the first member reverse to the first surface, wherein:

the first member has a thickness L which satisfies the following condition:

$$L=\lambda\times(2n+1)/4,$$

where λ is a wavelength of an acoustic wave traveling through the first member, and n is an integer not smaller than zero; and an acoustic impedance $Z_1$ of the liquid in the common flow channel, an acoustic impedance $Z_2$ of the first member, and an acoustic impedance $Z_3$ of the second member satisfy one of the following conditions: $Z_1<Z_2<Z_3$, and $Z_3<Z_2<Z_1$.

2. The liquid ejection head as defined in claim 1, wherein the acoustic impedance $Z_1$ of the liquid in the common flow channel, the acoustic impedance $Z_2$ of the first member, and the acoustic impedance $Z_3$ of the second member satisfy the following condition: $Z_2\cong\sqrt{Z_1Z_3}$.

3. The liquid ejection head as defined in claim 1, wherein the common flow channel is disposed on a side of the pressure chambers reverse to a side adjacent to the nozzles.

4. The liquid ejection head as defined in claim 1, wherein the portion of the wall is disposed on a side of the common flow channel reverse to a side adjacent to the pressure chambers.

5. The liquid ejection head as defined in claim 1, wherein:

the second member includes a liquid tank in which the liquid to be supplied to the common flow channel is stored; and a supply flow channel which connects the liquid tank to the common flow channel is formed in the first member.

6. The liquid ejection head as defined in claim 5, further comprising a filter member which is arranged in at least a portion of the supply flow channel.

7. The liquid ejection head as defined in claim 6, wherein the portion of the supply flow channel where the filter member is arranged has a cross-sectional area broader than that of the other portions of the supply flow channel.

8. The liquid ejection head as defined in claim 1, wherein a heater wire is arranged in the first member.

9. The liquid ejection head as defined in claim 1, wherein a Peltier element is arranged in the first member.

10. The liquid ejection head as defined in claim 1, wherein a liquid circulation path is formed in the first member.

11. The liquid ejection head as defined in claim 1, wherein wiring members for driving the pressure generating devices are arranged in the first member.

12. An image forming apparatus, comprising the liquid ejection head as defined in claim 1.

* * * * *